US005787980A

United States Patent [19]

Sparlin et al.

[11] Patent Number: 5,787,980

[45] Date of Patent: Aug. 4, 1998

[54] WELL SCREEN HAVING A UNIFORM OUTER DIAMETER

[75] Inventors: Derry D. Sparlin, Spring, Tex.; Tadayoshi Nagaoka, Mihara-machi, Japan

[73] Assignee: Nagaoka International Corporation, Mihara-machi, Japan

[21] Appl. No.: 345,613

[22] Filed: Nov. 28, 1994

[30] Foreign Application Priority Data

Dec. 1, 1993 [JP] Japan ..... 5-338870

[51] Int. Cl.[6] ..... E21B 43/08

[52] U.S. Cl. ..... 166/231; 166/233

[58] Field of Search ..... 166/231, 232, 166/233, 234, 235

[56] References Cited

U.S. PATENT DOCUMENTS

| | | | |
|---|---|---|---|
| 725,117 | 4/1903 | Morris | 166/231 |
| 2,353,881 | 7/1944 | Crake | 166/231 |
| 4,657,079 | 4/1987 | Nagaoka | 166/231 |
| 4,771,829 | 9/1988 | Sparlin | 166/233 |
| 4,945,991 | 8/1990 | Jones | 166/51 X |

*Primary Examiner*—Stephen J. Novosad

*Attorney, Agent, or Firm*—Bernard A. Reiter; Mark L. Berrier

[57] ABSTRACT

A well screen is composed of a plurality of screen units connected in series. Each of said screen units has a cylindrical connecting section at least at one end thereof and includes a plurality of support rods extending in the axial direction of the screen disposed cylindrically about a section of the screen other than the connecting section at a predetermined interval in the circumferential direction of the screen, and a wire wound on the outer periphery of said support rods so as to form slits of a predetermined width. The well screen further includes outer diameter equalizing means provided about adjacent ones of the connecting sections of two of the screen units connected to each other for substantially equalizing the outer diameter of said connecting sections to the outer diameter of sections other than the connecting sections.

14 Claims, 14 Drawing Sheets

WELL SCREEN HAVING A UNIFORM OUTER DIAMETER

BACKGROUND OF THE INVENTION

This invention relates generally to the field of oil well, gas well, water well and subterranean pollution remediation well equipment.

Many types of screens and filtering devices are known in the art that are designed to exclude sand and other solids from fluids and gases produced from oil gas, water and pollution remediation wells without undue restriction of the production rate of fluids or gases. These devices are often used with filter aids, such as gravel and/or sand, which are either incorporated within the device or separately placed surrounding the device.

Wire wrapped screens and prepacked screens are examples of devices used inside a drilled hole. The drilled hole may be left open or may have a casing or liner cemented and perforated prior to positioning such a device. Openings in such screens may be designed to stop, or bridge undesirable solids contained in fluids or gases.

Screens and well liners are often surrounded by filter aids. The filter aids consist commonly of gravel. When used with filter aids or gravel, the openings in the screens and liners are designed to stop, or bridge, the filter aid and the filter aid is designed to stop or bridge the undesirable solids contained in the produced fluids or gases.

Prepacked screens, porous material filter devices and such are examples of devices that incorporate a filter medial in the screen body. These devices are used for the same purpose and these filter aids commonly consist of gravel.

Multiple wrapped screens provide two or more concentric wire wrappings which act as multiple filters in one device to prevent invention of undesirable solids and are often used with filter aids, such as gravel, in the well bore.

As shown in FIG. 13, screen units of conventional well screens usually consist of lengths (joints) of from 5 to 10 meters with short lengths of blank (non-screen) pipe at each end. The purposes of the short lengths of blank pipe at each end are (1) to provide a means of connecting the joints together at a well site and (2) to facilitate holding each screen joint in a well-head as the joints are assembled for lowering into the well.

The length of blank sections at the ends of each joint of screen must be long enough to allow for threads required for connecting the joints, and must be long enough to allow room to hang each joint in the well-head while joints are connected together. The total blank length is commonly 0.5 to 1 meter, after two joints have been connected together.

A screen consisting of screen units which are connected together is commonly lowered, and centrallized, in a well bore to a position adjacent to a fluid or gas productive subterranean formation, wherefrom the fluid or gas can flow radially through the screen. The screen prevents entrance of undesirable solid particles and allows flow of fluid or gas inside the screen to be produced to the surface.

For improving efficiency of production of oil from an oil well, there is an increasing tendency to producing oil from a high angle well which is deviating from the vertical by 45 degrees to 90 degrees plus by passing a well screen into this high angle well.

A problem which arises from the conventional type of well screen installed in such a high angle well is that, in inserting a screen in a wellbore, the screen is not centrallized as in the case of a screen in a vertical wellbore but the screen is inserted with a side thereof coming into contact with the bottom surface of the wellbore. Therefore, as shown in FIG. 14 which shows a wellbore extending horizontally, the foremost lower edge portion of a screen portion d of a screen s which advances in the direction X in a wellbore w and the foremost lower edge portion of a threaded coupling e of a blank portion b scrape up earth g of a bottom surface f of the welibore w, and this earth g is heaped up in front of the lower edge portion of the screen portion d and the coupling e of the blank portion b and thereby prevents the advancement of the screen s in the direction X.

Another problem arising from a high angle wellbore is that gravel is not packed uniformly due to existence of the blank portion in the screen.

Gravel is normally packed most tightly in a location in an annulus between the screen and the wellbore where fluid carrying the gravel circulates through the screen. Therefore, gravel cannot be packed so tightly in an annulus about the blank portion as in an annulus about the screen portion. In a vertical wellbore, gravel can be packed to some degree about the blank portion due to gravity but, in a high angle welibore, as shown in FIG. 15, gravel h moves toward the bottom side of a wellbore w due to gravity and cannot be packed in a space about a blank portion b, so that a space i which is not packed with gravel is generated in the vicinity of the blank portion b.

Gravel in the screen/wellbore annulus can then shift and slump after the well is put on production and this can form voids or unpacked annulus areas. Annulus areas where gravel is not tightly packed form paths for undesirable sand or solids from an unconsolidated sand formation to enter the wellbore and erode the screen, clog the screen openings, and/or to fill the inside of the wellbore with unwanted solids.

U.S. Pat. No. 4,945,991, Jones, L. G., "Methods for Gravel Packing Wells" discloses a screen with substantially rectangular perforated shunt tubes attached to the outside of a screen longitudinally over the entire length of the screen, and connected between all sectional lengths of screens attached together to provide flow paths for the gravel laden fluid to flow into and pack voids or unpacked areas of the screen/wellbore annulus. This device allows the gravel/fluid slurry to enter and flow through multiple flow paths near or above the screen and to thereafter flow both down the screen/wellbore annulus or down one or more of the appendaged perforated shunt tubes. Dehydration of the slurry in the perforated shunt tubes is inhibited by combination of limited area of perforations in the tubes and by the flow of gravel slurry down the screen/wellbore annulus, thus gravel slurry in the perforated shunt tubes is much less likely to be dehydrated and is most likely to flow continuously through the shunt tubes until it reaches the vicinity of a portion of the screen/wellbore annulus that is void of gravel or is not fully packed with gravel, then the gravel slurry in the perforated shunt tubes will flow into the inadequately gravel packed annulus.

A problem with the device of U.S. Pat. No. 4,945,991 is that the blank sections at the ends of each screen section have no screen through which fluid can flow during gravel packing or after the well is put on production.

It is, therefore, a first object of the invention to provide an improved well screen suitable for use in a high angle wellbore which is capable of preventing earth from being heaped up in front of a connecting section of the screen by scraping of earth of the bottom surface of the wellbore by the lower edge portion of the advancing screen.

It is a second object of the invention to provide a well screen which enables packing of gravel efficiently in the entire annulus between the screen and the wellbore.

SUMMARY OF THE INVENTION

For achieving these objects of the invention, in a well screen composed of a plurality of screen units connected in series, each of said screen units having a cylindrical connecting section at least at one end thereof and including a plurality of support members extending in the axial direction of the screen disposed cylindrically about a section of the screen other than the connecting section at a predetermined interval in the circumferential direction of the screen, and wire means wound on the outer periphery of said support members so as to form slits of a predetermined width, the improvement comprises outer diameter equalizing means provided about adjacent ones of the connecting sections of two of the screen units connected to each other for substantially equalizing the outer diameter of said connecting sections to the outer diameter of sections other than the connecting sections.

In the claims and specification of this application, the term "connecting section" means a threaded tube section provided at an end of each screen unit for connection with an adjacent screen unit and a blank section adjacent to this threaded tube section which has been provided in the screen unit of the conventional well screen for hanging the screen unit at the well head.

According to the invention, by providing the outer diameter equalizing means about adjacent ones of the connecting sections of two of the screen units connected to each other for substantially equalizing the outer diameter of the connecting sections to the outer diameter of sections other than the connecting sections, the surfaces of the adjacent screen units become continuously flush with each other without producing any step in the connecting sections. Accordingly, in inserting the screen into a high angle wellbore, the foremost lower edge portion of each screen unit of the advancing screen does not scrape up the earth of the bottom surface of the wellbore and, therefore, heaping of earth in front of the connecting section of the screen unit can be effectively prevented.

In one aspect of the invention, the outer diameter equalizing means comprises a plurality of support members extending in the axial direction of screen disposed cylindrically at a predetermined interval in the circumferential direction of the screen about at least said one connecting section of at least one of the screen units, and wire means wound on the outer periphery of said support members so as to form slits of a predetermined width, said connecting section being formed with openings which allow flow of fluid between the inside and the outside of said screen unit through the slits of said wire means.

According to this aspect of the invention, since fluid flows from the outside of the screen to the inside thereof through the screen composed of the support members and wire means provided about the connecting section of each screen unit and the openings formed in the connecting section, this enables intake of fluid from the connecting section of the screen unit which has not been used for intake of fluid in the conventional well screen. As a result, potential production efficiency of the screen increases and hence the efficiency of fluid production from the well is improved.

Embodiments of the invention will be described below with reference to the accompanying drawings.

DESCRIPTION OF PREFERRED EMBODIMENTS

Figure 1:
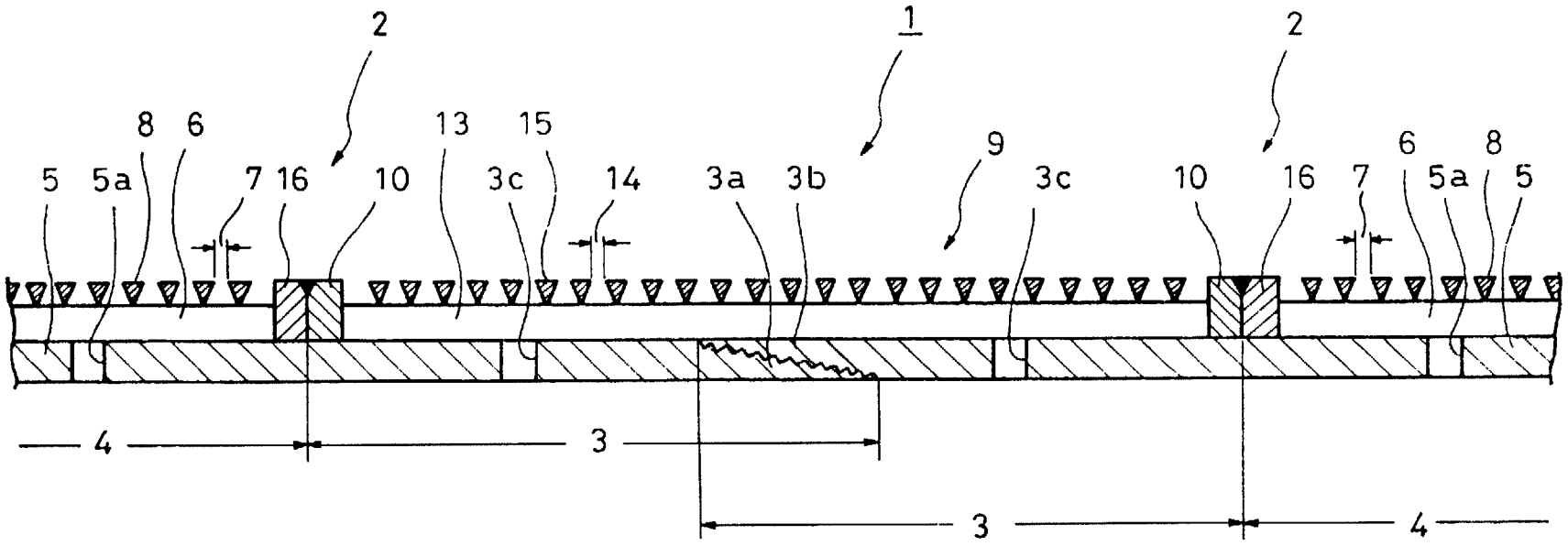
FIG. 1 is a partial sectional view of an embodiment of a screen made according to the invention.
Figure 2:
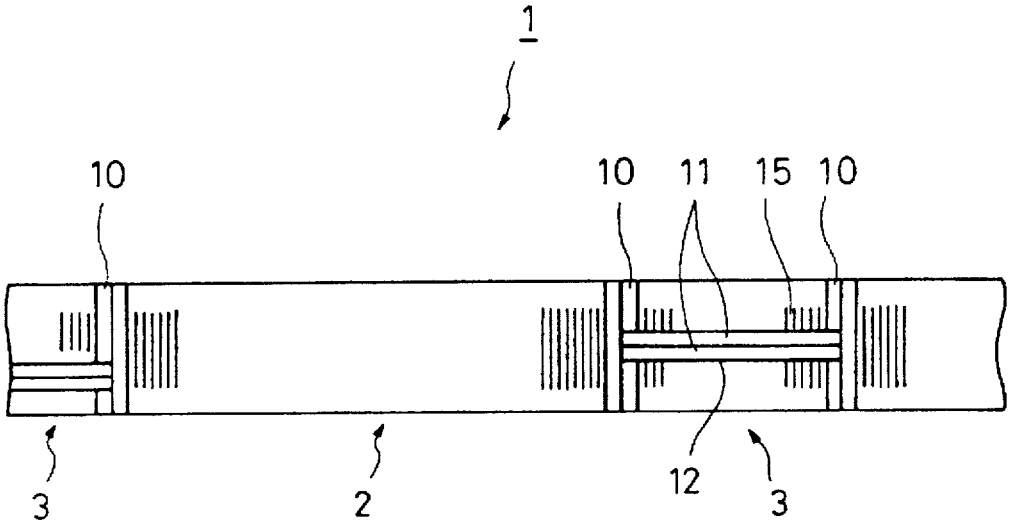
FIG. 2 is a side view of a part of this embodiment.

FIGS. 1 to 7 show an embodiment of the well screen according to the invention. In this embodiment, the outer diameter equalizing means is constructed as a screen jacket which is made of two screen portions each of which includes a plurality of support rods and a wire wound on the outer periphery of the support rods.

A well screen 1 is made of a plurality of screen units 2 connected in series. Each of the screen units 2 has connecting sections 3 provided at both ends and a screen section 4 between the connecting sections 3.

In the present embodiment, the screen section 4 of each screen unit 2 includes a pipe 5 formed with fluid intake perforations 5*a* at a predetermined interval, support rods 6 extending in the axial direction of the screen 1 disposed cylindrically at a predetermined interval in the circumferential direction of the screen 1 and a wire 8 such as a wedge wire wound on the outer periphery of the support rods 6 so as to form slits 7 of a predetermined width.

Figure 7:
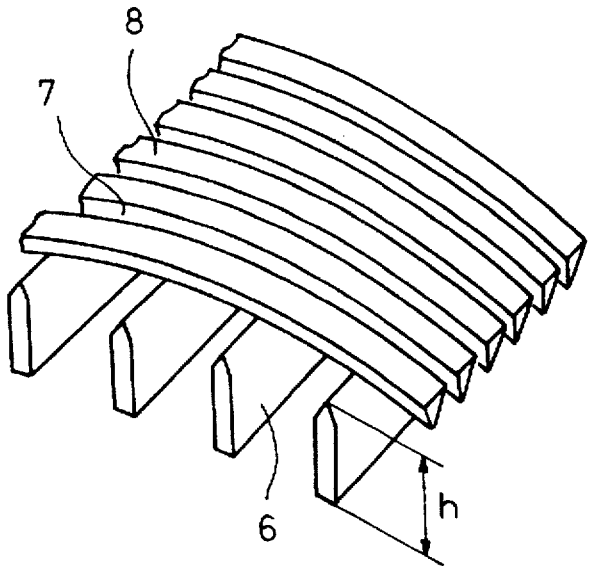
FIG. 7 is a perspective view showing an arrangement of wires d support rods.

As shown in FIG. 7, the support rods 6 are made of plate-like members which have a predetermined height in the radial direction of the screen 1 and have a substantially triangular cross section at one end. The wire 8 is welded to the support rods 6 at respective crossing points between the wire 8 and the support rods 6.

In the present embodiment, the connecting section 4 is formed by extending the pipe 5 of the screen section 4 with its diameter being maintained unchanged. A male screw 3*a* is formed on one connecting section 3 of one of the screen units 2 and a female screw 3*b* is formed on the other connecting section 3 of the screen unit 2. The male screw 3*a* and the female screw 3*b* of opposite connecting sections of two adjacent screen units 2 are threaded together to connect the screen units 2.

Figure 3:
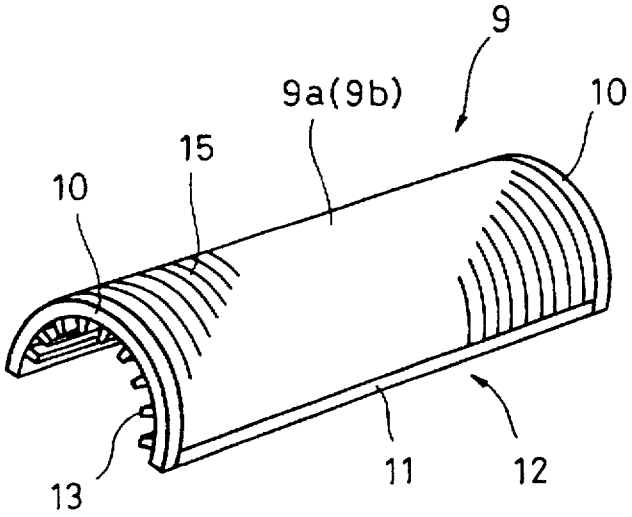
FIG. 3 is a perspective view showing a part of a screen jacket disposed at the connecting section.

A screen jacket 9 consisting of two screen portions 9a, 9b each having a semi-circular cross section as shown in FIG. 3 is disposed in such a manner that it will embrace the mutually connected connecting sections 3. Each of these screen portions 9a, 9b includes a frame 12 consisting of semi-circular flanges 10, 10 provided at both ends of the screen portion 9a (9b) in the axial direction and straight frame bars 11, 11 provided at both ends of the screen portion 9a (9b) in the circumferential direction, support rods 13 welded to this frame 12, extending in the axial direction and disposed at predetermined interval in the circumferential direction, and a wire 15 wound on the outer periphery of the support rods 13 to form slits 14 of a predetermined width.

The connecting section 3 is formed with perforations 3c to allow flow of fluid between the outside and the inside of the screen unit 2 through the slits 14 of the wire 15 in the connecting section 3.

Figure 4:
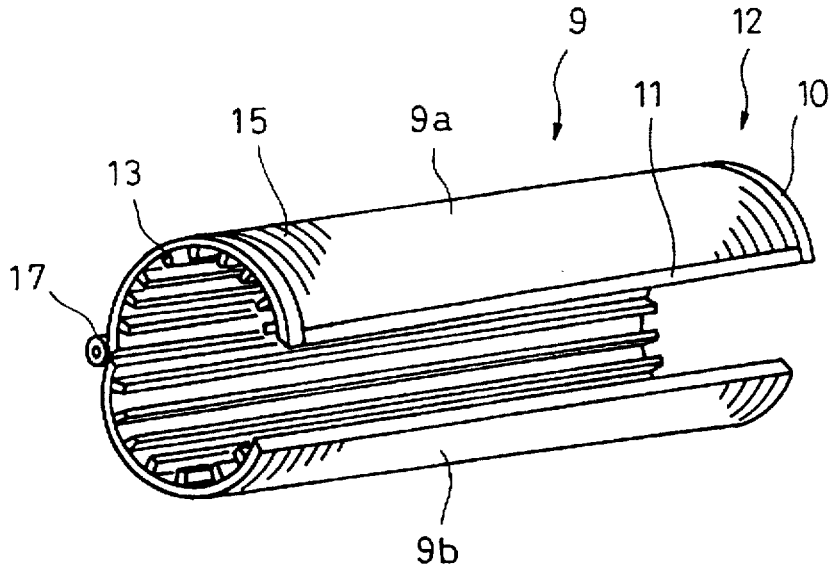
FIG. 4 is a perspective view showing two screen sections of a screen jacket being hingedly connected to each other.

For installing this screen 1, the upper connecting section 3 of a preceding screen unit 2 which is suspended in the wellbore is threaded with the lower connecting section of a following screen unit 2. Then, the screen portions 9a, 9b of the screen jacket 9 are mounted on the connecting sections 3 and the screen portions 9a and 9b are welded together at the straight frames 11. The screen portions 9a, 9b are also welded at the semi-circular flanges 10 to flanges 16 of adjacent screen sections 4 to seal the screen jacket 9 against invasion of sands from outside. FIG. 4 shows another example of connecting two screen portions of the screen jacket 9. In this example, two screen portions 9a, 9b are connected to each other by means of a hinge 17 at one end in the circumferential direction so that the two screen portions 9a, 9b are openable from a closed state. In the following embodiments of the invention, the same components as those in FIG. 1 are designated by the same reference characters and description thereof will be omitted.

Alternatively, the two screen portions 9a, 9b may be connected to each other by means of bolts and nuts at the straight frame bars 11.

Figure 5:
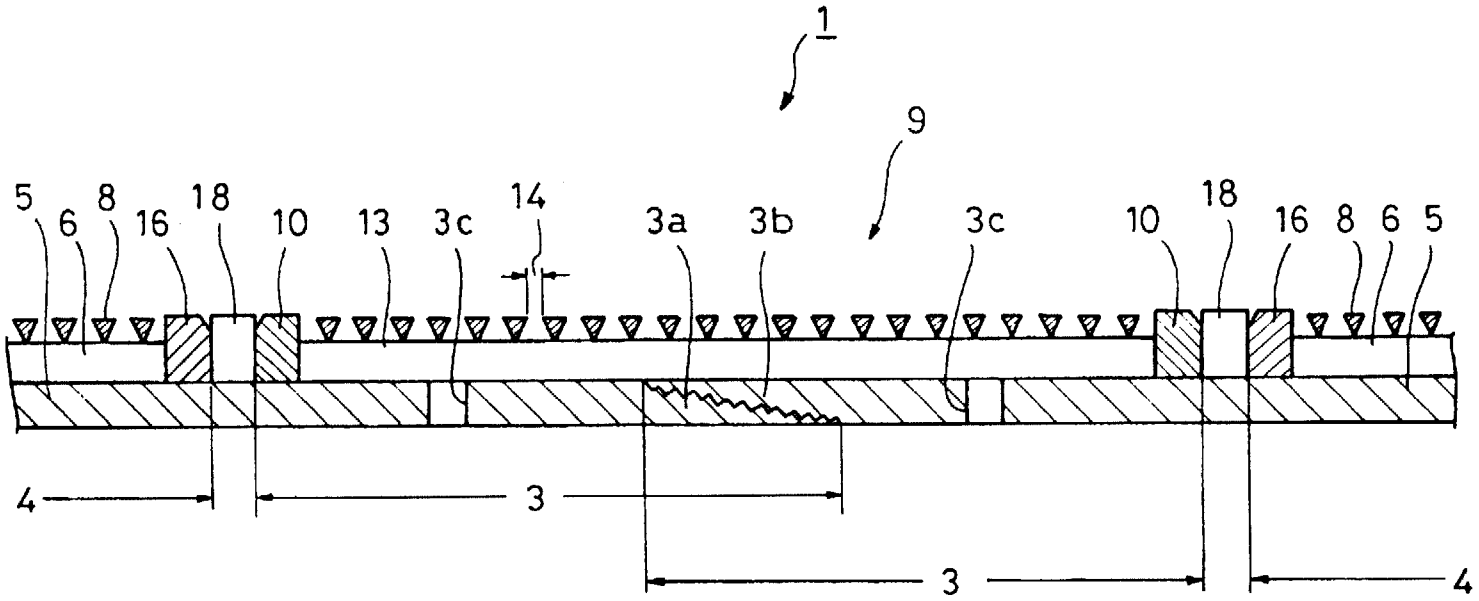
FIG. 5 is a partial sectional view showing another example of connection of the screen jacket.

FIG. 5 shows another example of sealing of the screen jacket 9 mounted on the connecting section 3. In this example, a small gap is provided between the flanges 10 of the screen portions 9a, 9b of the screen jacket 9 and the flanges 16 of the screen sections 4 and a seal member 18 made of rubber, sealant or the like material is filled in this gap to seal the screen jacket 9 from the outside.

Figure 6:
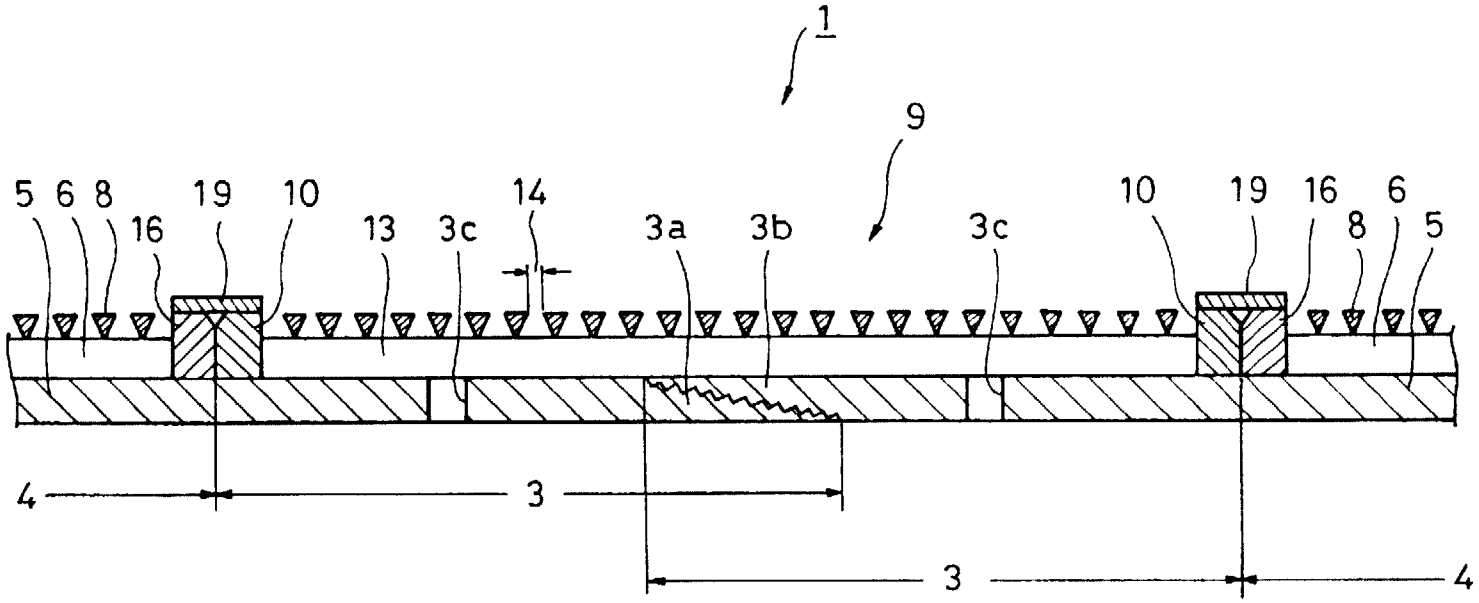
FIG. 6 is a partial sectional view showing another example of connection of the screen jacket.

FIG. 6 shows another example of sealing of the screen jacket 9 mounted on the connecting section 3. In this example, the flanges 10 of the screen portions 9a, 9b are in abutting engagement with the flanges 16 of the screen sections 4 and the flanges 10 and 16 which are thus in abutting engagement with each other are bound by annular steel bands 19 which are fastened tightly about the flanges 10 and 16 by means of an unillustrated fastening means to provide a seal of the screen jacket 4 from the outside.

In the embodiments shown in FIGS. 1 to 7, the support rods and the wire wound about these support rods in the connecting section of the screen unit are constructed in the form of the screen jacket consisting of plural screen portions divided circumferentially. Alternatively, these support rods and the wire in the connecting section may be constructed as a single cylindrical screen jacket which is not divided circumferentially in plural portions and this screen jacket may be slipped on the connecting sections of two adjacent screen units. In this case also, a gap produced between the screen jacket and the adjacent screen units should desirably be sealed by means of O-rings or other sealing means.

Figure 8:
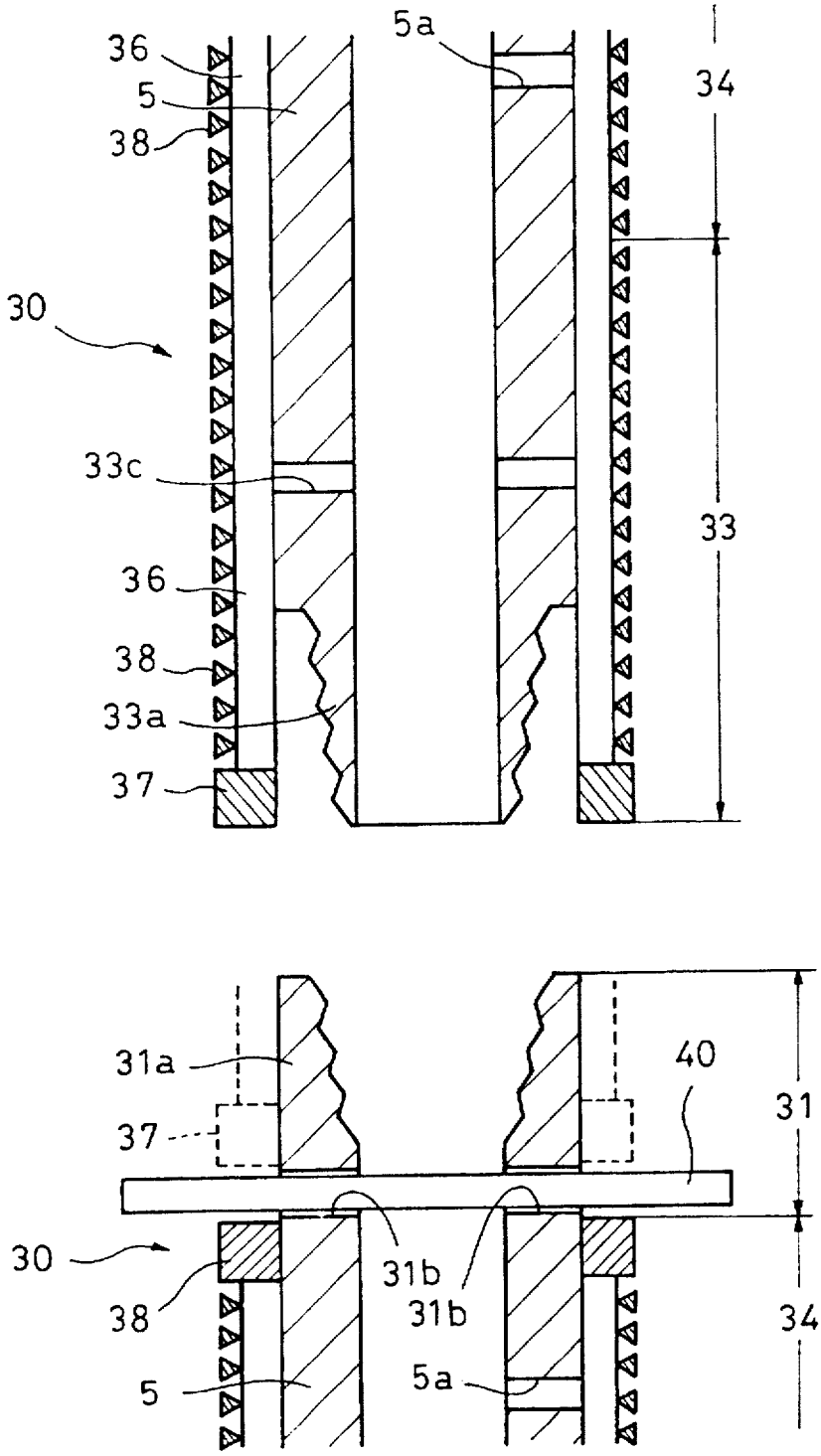
FIG. 8 is a partial sectional view showing another embodiment of the invention.
Figure 9:
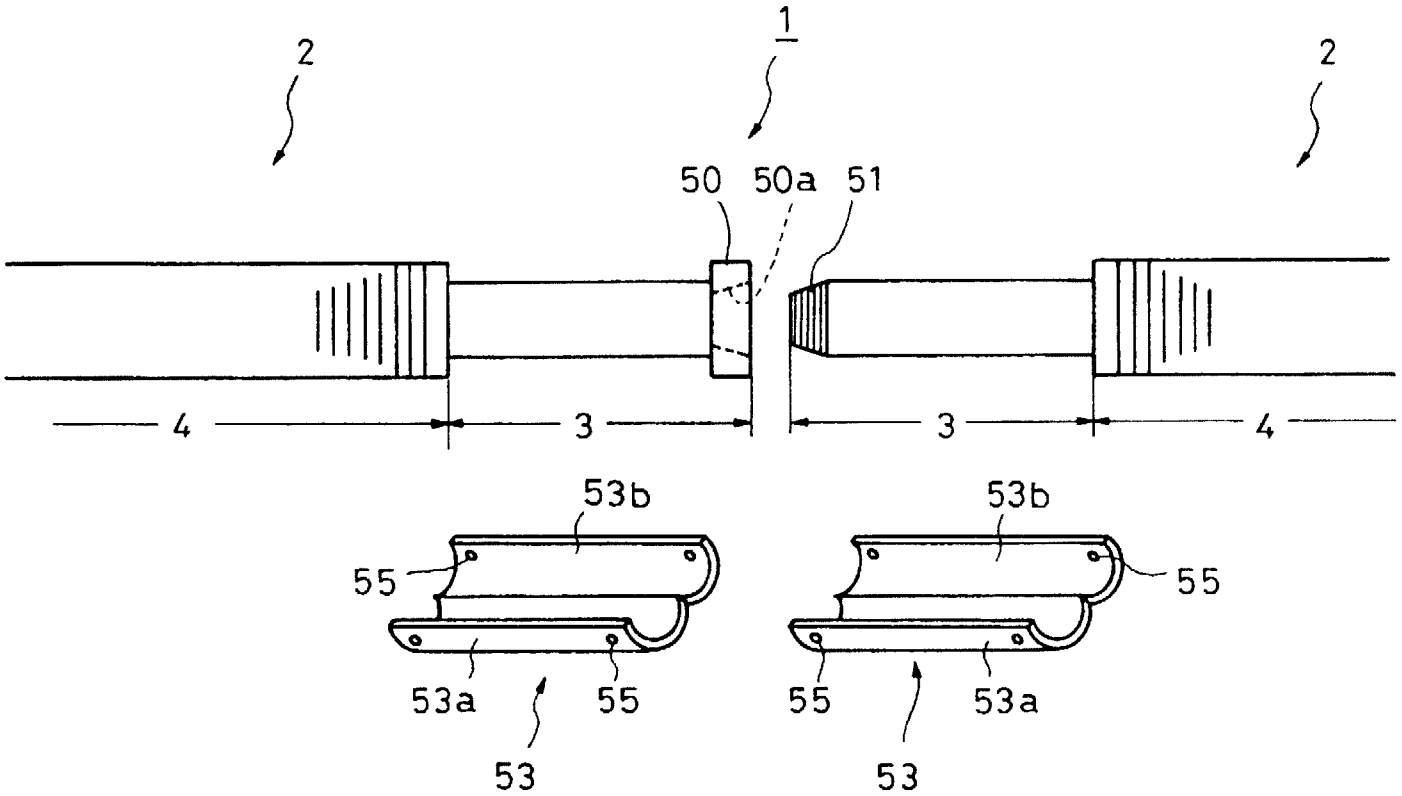
FIG. 9 is a view schematically showing another embodiment of the invention.
Figure 10:
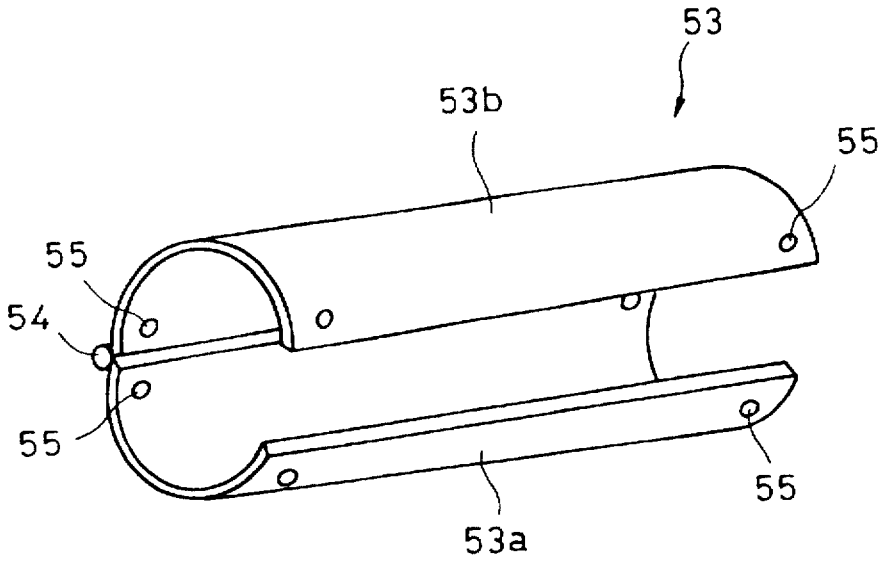
FIG. 10 is a perspective view showing a cover plate of this embodiment.
Figure 11:
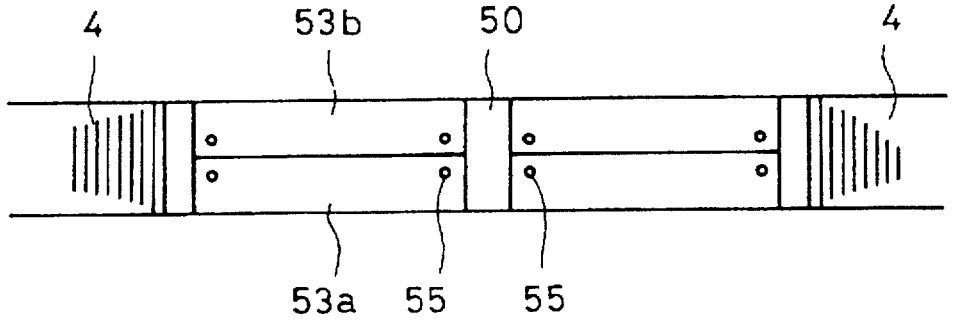
FIG. 11 is a side view showing mounting of the cover plates on the connecting sections.

FIG. 8 shows another embodiment of the well screen made according to the invention.

In this embodiment, support rods 36 and a wire 38 provided in a connecting section 33 of an upper screen unit 30 are formed by extending support rods 36 and a wire 38 wound thereon in a portion other than the connecting section 33, that is, a screen section 34 integrally and continuously over the outer periphery of the connecting section 33 to the end of the connecting section 33.

A pipe 5 in the connecting section 33 is formed with fluid intake perforations 33c.

The screen unit 30 of which one end has the above described structure has, at the other end, no support rods or screen wire in a connecting section 31 adjacent to the screen section 34 and has no fluid intake perforations as shown in a lower screen unit 30 of FIG. 8.

This connecting section 31 is formed with a diametrically opposed pair of perforations 31b for inserting a support member 40 therethrough for suspending the screen unit 30 from the peripheral edge portion of the wellhead.

For installing this well screen, as shown in FIG. 8, the support member 40 is previously inserted through the perforations 31b of the connecting section 31 of the lower screen unit 30 and this screen unit 30 is suspended in the wellbore with the support member 40 crossing the wellbore and supported at the peripheral edge of the wellhead.

Then, a male screw 33a of the upper screen unit 30 is threaded with a female screw 31a of the lower screen unit 30 until a flange 37 of the upper screen unit 30 is lowered to a position shown by a dotted line in the figure. Then the support member 40 is pulled off the perforations 31b and a gap between flanges 37 and 38 including the perforations 31b is sealed by means of a sealant or the like material.

FIGS. 9 to 12 show another embodiment of the invention. In this embodiment, the outer diameter equalizing means consists of a cylindrical cover plate which is composed of portions having a form obtained by dividing a cylinder in the circumferential direction. The cover plate has an outer diameter which is substantially equal to the outer diameter of a screen portion other than the connecting section. In the embodiment of FIGS. 9 to 12, the same components as those in the embodiment of FIGS. 1 to 8 are designated by the same reference characters and description thereof is omitted.

In this embodiment, an annular coupling 50 for enlarging the diameter is mounted on one end of a connecting section of a lower screen unit 2. The coupling 50 is formed with a female screw 50a on the inner peripheral surface thereof. A connecting portion 3 of an upper screen unit 2 is formed with a male screw 51 which can be threaded with the female screw 50a.

Figure 12:
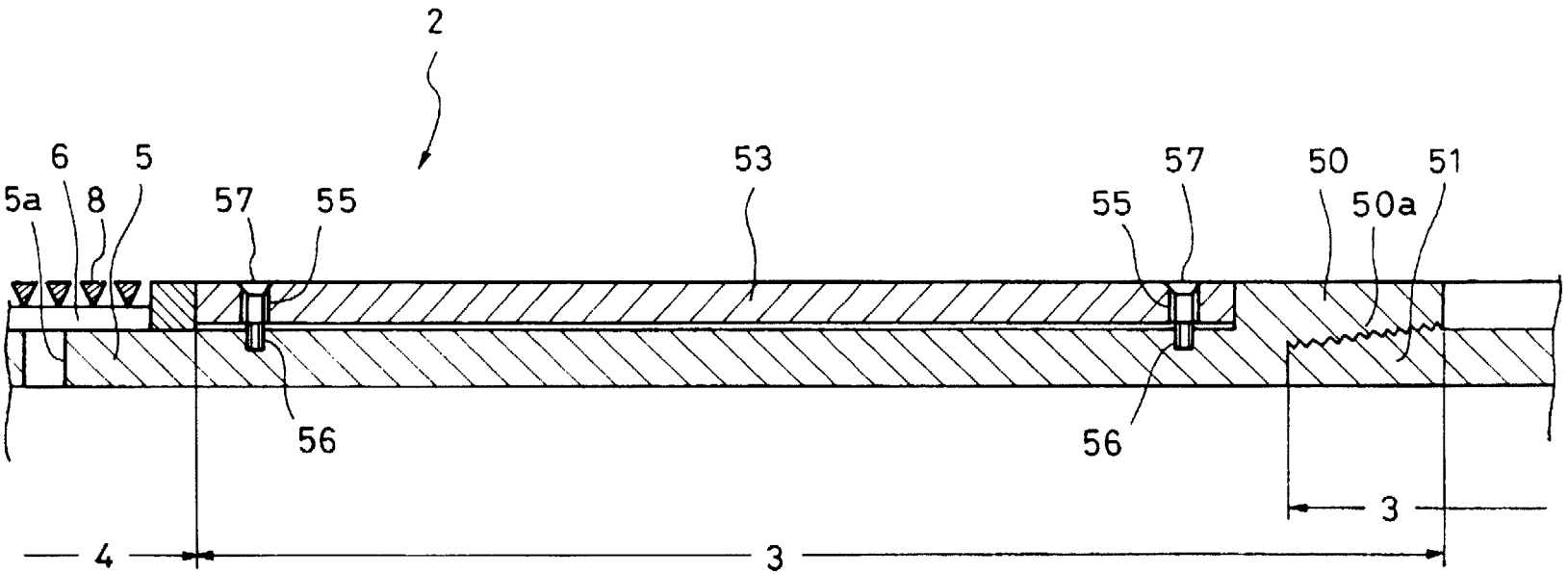
FIG. 12 is a partial sectional view showing the connecting section of this embodiment.
Figure 13:
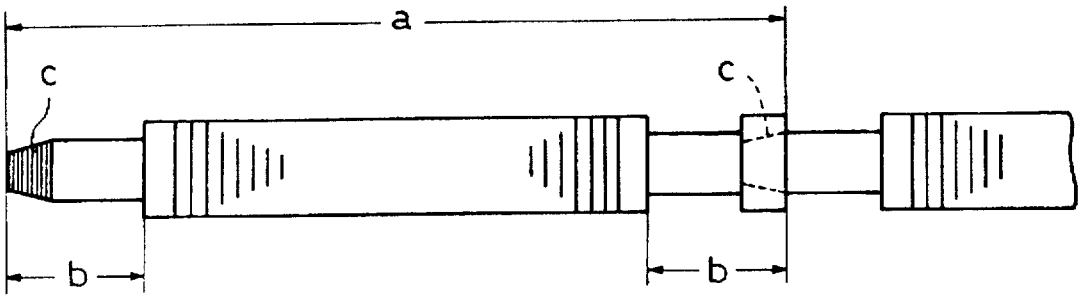
FIG. 13 PRIOR ART
FIG. 13 is a side view showing a prior art well screen.
Figure 14:
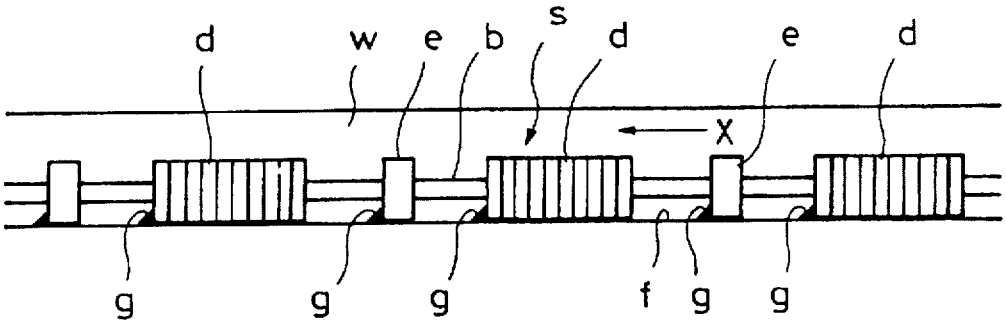
FIG. 14 PRIOR ART
FIG. 14 is a view showing the state of advancing of a prior art screen through a high angle wellbore.
Figure 15:
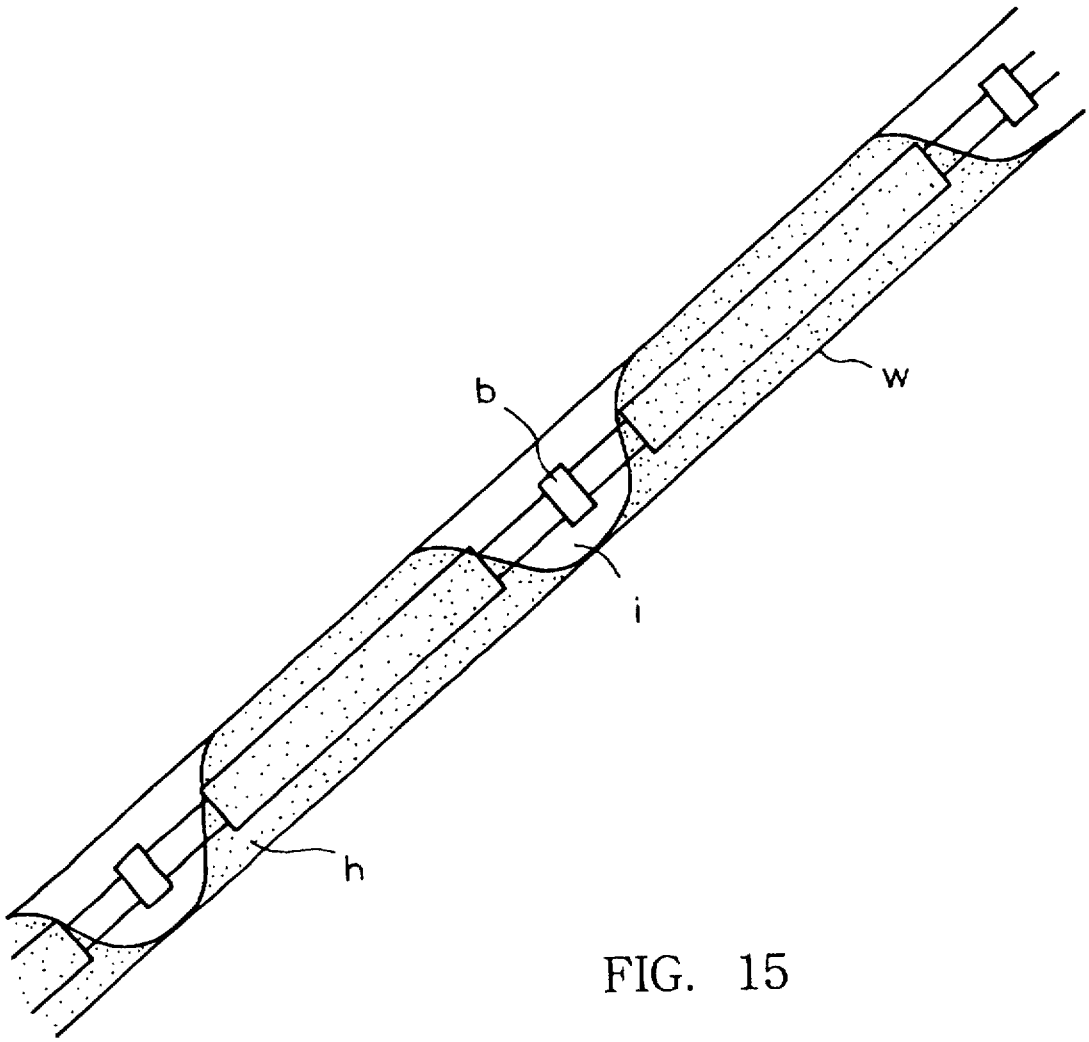
FIG. 15 PRIOR ART
FIG. 15 is a view showing a state of packing of gravel about a prior art screen in a high angle wellbore.

Cylindrical cover plates 53, 53 each of which is made of two plate portions 53a, 53a of a semi-circular cross section which are hingedly connected to each other by means of a hinge 54 are disposed about the mutually connected connecting sections 3, 3 of the upper and lower screen units 2, 2 so as to embrace the connecting sections 3, 3. Each of the cover plates 53, 53 is formed at end portions thereof with screw insertion holes 55 and a pipe 5 in the connecting sections 3, 3 is formed at corresponding positions with screw holes 56 (FIG. 12). After the cylindrical cover plates 53, 53 are mounted on the connecting sections 3, 3, the cover plates 53, 53 are fixed to the pipe 5 in the connecting sections 3, 3 by providing screws 57 (FIG. 12) in the screw holes 56 through the screw insertion holes 55.

The manner of fixing the cylindrical cover plates 53 is not limited to the above described manner but various other means including those used for fixing the screen jacket in the embodiment of FIGS. 1 to 7 may be employed.

Figure 16:
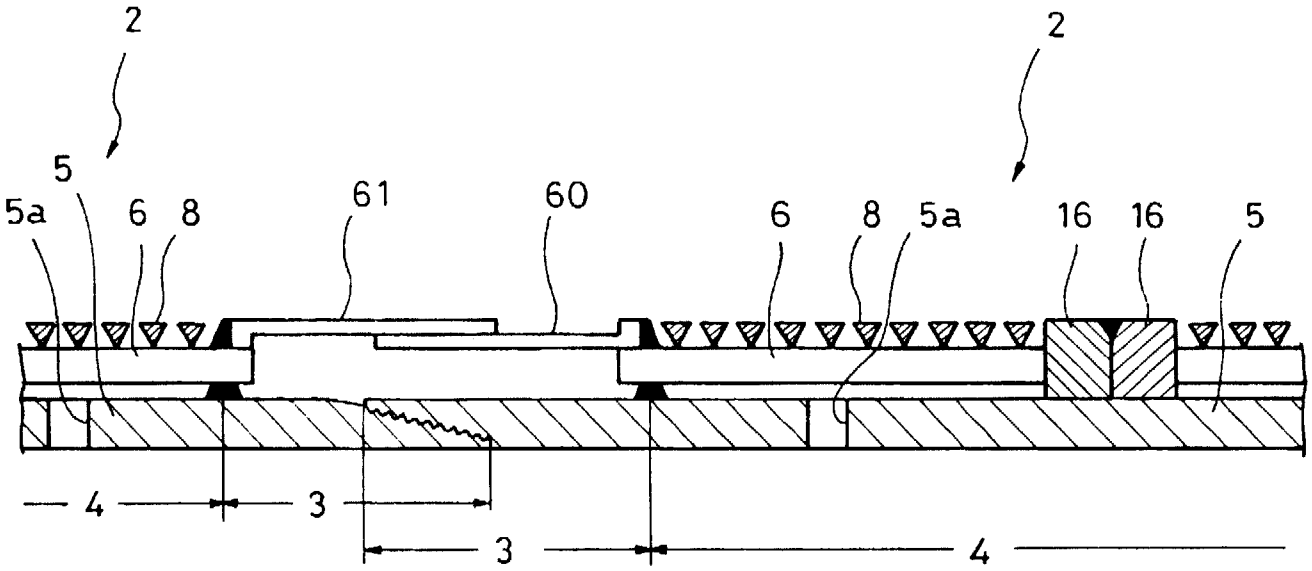
FIGS. 16 and 17 are partial sectional views showing other embodiments of the invention.

FIG. 16 shows a still another embodiment of the invention. In this embodiment, the same components as those in the embodiment of FIGS. 1 to 7 are designated by the same reference characters and description thereof is omitted.

Figure 17:
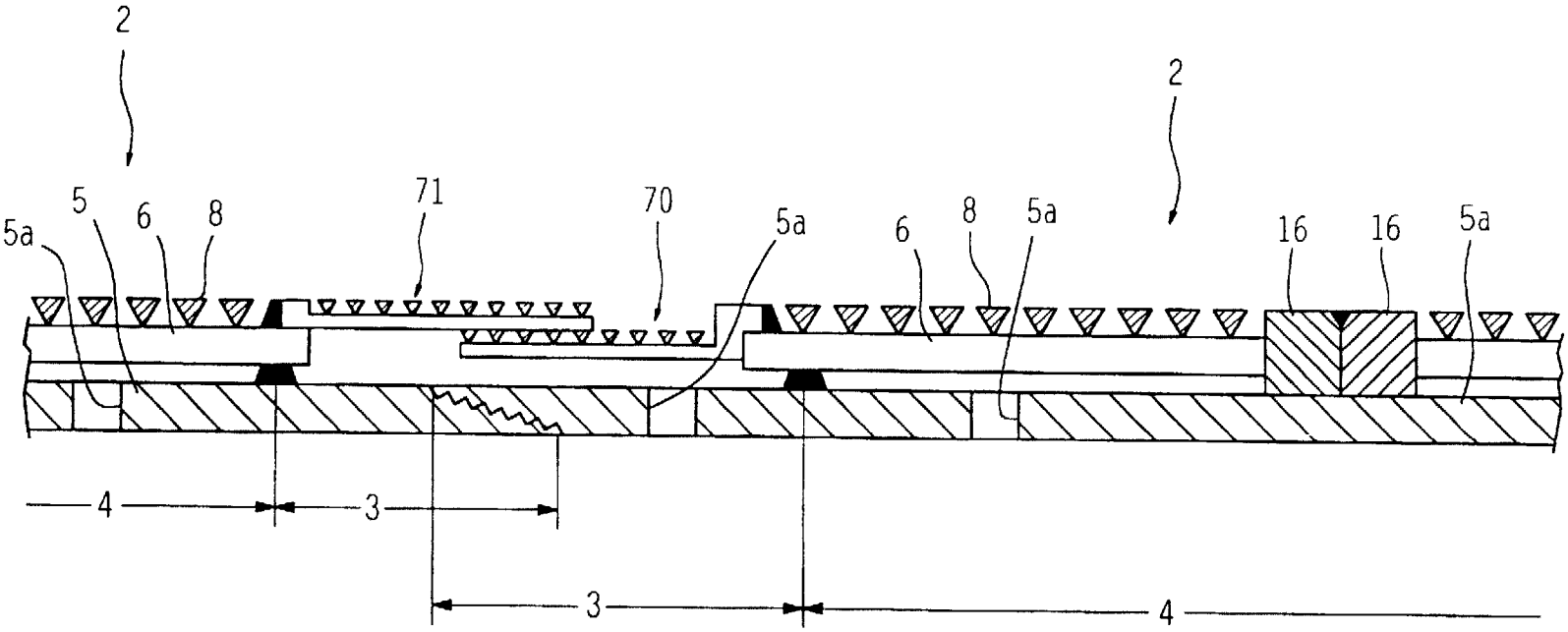

In this embodiment, cylindrical cover plates 60, 61 which constitute the outer diameter equalizing means are welded to end portions of support rods 6 to embrace connecting sections 3, 3 of adjacent screen units 2, 2. The cover plates 60, 61 are disposed at such location that, when the connecting sections 3, 3 are connected to each other, a part of the outer peripheral surface of the cover plate 60 is in contact with a part of the inner peripheral surface of the cover plate 61. In this embodiment, when one connecting section 3 is rotated for threaded engagement with the other connecting section 3, one of the cover plates 60, 61 of the rotating connecting section 3 comes into engagement with the other to achieve the structure in which the outer surfaces of the adjacent screen units 2, 2 become flush with respect to each other as shown in FIG. 16. Alternatively, the cover plates 60, 61 may be replaced by cylindrical screens 70/71 and the connecting sections 3, 3 may be formed with fluid intake perforations as shown in FIG. 17. The inner peripheral surface of the cover plate 61 and the outer peripheral surface of the cover plate 60 need not necessarily be in contact with each other but there may be formed a gap between these surfaces.

This invention is applicable to the well screens having a perforated pipe base as described above and also to a selective isolation type screen disclosed in U.S. Pat. No. 4,771,829. As the base of the well screen, not only a perforated pipe, a spiral wire or a plurality of rings arranged with a predetermined interval in the axial direction of the screen as disclosed in U.S. Pat. No. 4,657,079 may be used. This invention is also applicable to all types of well screens including a well screen having shunt tubes as disclosed in U.S. Pat. No. 4,945,991 a dual cylinder screen as disclosed in Japanese Patent Application Laid-open No. Hei-5-44386.

What is claimed is:

1. In a well screen composed of a plurality of screen units connected in series, each of said screen units having a cylindrical connecting section at least at one end thereof and including a plurality of support members extending in the axial direction of the screen disposed cylindrically about a section of the screen other than the connecting section at a predetermined interval in the circumferential direction of the screen, and wire means wound on the outer periphery of said support members so as to form slits of a predetermined width, the improvement comprising outer diameter equalizing means provided about adjacent ones of the connecting sections of two of the screen units connected to each other for substantially equalizing the outer diameter of said connecting sections to the outer diameter of sections other than the connecting sections, said outer diameter equalizing means having a plurality of support members extending in the axial direction of screen disposed cylindrically at a predetermined interval in the circumferential direction of the screen about at least said one connecting section of at least one of the screen units; and wire means wound on the outer periphery of said support members so as to form slits of a predetermined width, said connecting section being formed with openings which allow flow of fluid between the inside and the outside of said screen unit through the slits of said wire means.

2. A well screen as defined in claim 1 wherein said support members disposed in the connecting section and said wire means wound on the outer periphery of said support members are constructed as a screen jacket consisting of screen portions obtained by dividing a cylindrical screen in the circumferential direction, said screen portions being connected to each other.

3. A well screen as defined in claim 2 wherein the screen portions of the screen jacket are hingedly connected to each other.

4. A well screen as defined in claim 2 wherein the screen portions of the screen jacket are welded to each other.

5. A well screen as defined in claim 2 wherein the screen portions of the screen jacket are connected to each other by means of bolts.

6. A well screen as defined in claim 2 wherein the screen portions of the screen jacket are connected to each other by binding them by a belt.

7. A well screen as defined in claim 1 wherein said support members disposed in the connecting section and said wire means wound on the outer periphery of said support members are formed by extending integrally and continuously support members disposed in the section of the screen other than the connecting section and the wire means wound on the outer periphery thereof to the outer periphery of said connecting section.

8. A well screen as defined in claim 7 wherein a connecting section of an adjacent screen unit to which said connecting section in which said support members and said wire means are formed by extending the support members and wire means of the section of the screen other than the connecting section has a portion in which support members and wire means do not exist and which is formed with a pair of diametrically opposed perforations for inserting a support member used for suspending the adjacent screen unit at a peripheral edge portion of a wellhead.

9. In a well screen composed of a plurality of screen units connected in series, each of said screen units having a cylindrical connecting section at least at one end thereof and including a plurality of support members extending in the axial direction of the screen disposed cylindrically about a section of the screen other than the connecting section at a predetermined interval in the circumferential direction of the screen, and wire means wound on the outer periphery of said support members so as to form slits of a predetermined width, the improvement comprising outer diameter equalizing means provided about adjacent ones of the connecting sections of two of the screen units connected to each other for substantially equalizing the outer diameter of said connecting sections to the outer diameter of sections other than the connecting sections, said outer diameter equalizing means having a cylindrical cover plate which consists of portions obtained by a cylinder in the circumferential direction, the outer diameter of said cover plate being substantially equal to the outer diameter of the section of the screen unit other than the connecting section.

10. A well screen as defined in claim 9 wherein the portions of the cover plate are hingedly connected to each other.

11. A well screen as defined in claim 9 wherein the portions of the cover plate are welded to each other.

12. A well screen as defined in claim 9 wherein the portions of the cover plate are connected to each other by means of bolts.

13. A well screen as defined in claim 9 wherein the portions of the cover plate are connected to each other by binding them by a belt.

14. In a well screen composed of a plurality of screen units connected in series, each of said screen units having a cylindrical connecting section at least at one end thereof and including a plurality of support members extending in the axial direction of the screen disposed cylindrically about a section of the screen other than the connecting section at a predetermined interval in the circumferential direction of the screen, and wire means wound on the outer periphery of said support members so as to form slits of a predetermined width, the improvement comprising outer diameter equalizing means provided about adjacent ones of the connecting sections of two of the screen units connected to each other for substantially equalizing the outer diameter of said connecting sections to the outer diameter of sections other than the connecting sections, said outer diameter equalizing means having a pair of cylindrical screens fixed to end portions of two adjacent screen units, said cylindrical screens being disposed at such a location that, when said connecting sections are connected to each other, one of said cylindrical screens is partially located inside of the other cylindrical screen.

* * * * *